US005787793A

United States Patent [19]

Niwa et al.

[11] Patent Number: 5,787,793

[45] Date of Patent: Aug. 4, 1998

[54] HYDRAULIC CYLINDER AND ASSEMBLY METHOD THEREOF

[75] Inventors: Susumu Niwa, Kani; Yukihiro Takada, Gifu-ken, both of Japan

[73] Assignee: Kayaba Industry Co., Ltd., Tokyo, Japan

[21] Appl. No.: 665,523

[22] Filed: Jun. 17, 1996

[30] Foreign Application Priority Data

Jun. 21, 1995 [JP] Japan ..... 7-176933

[51] Int. Cl.[6] ..... F04D 10/02

[52] U.S. Cl. ..... 92/128; 92/168

[58] Field of Search ..... 92/164, 128, 165 R, 92/168

[56] References Cited

U.S. PATENT DOCUMENTS

| | | | |
|---|---|---|---|
| 2,533,531 | 12/1950 | Stephens | 92/164 |
| 2,549,818 | 4/1951 | Joy | 92/168 |
| 2,865,401 | 12/1958 | Majneri | 92/164 |

FOREIGN PATENT DOCUMENTS

| | | | |
|---|---|---|---|
| 947437 | 7/1956 | Germany | 92/164 |
| 2241050 | 8/1972 | Germany | 92/168 |

*Primary Examiner*—Sheldon Richter

*Attorney, Agent, or Firm*—Steinberg & Raskin, P.C.

[57] ABSTRACT

A hydraulic cylinder with which it is possible to promote cost reduction and weight reduction by reducing the number of parts, ensure that a sealing function is fully performed and also make possible a reduction in size comprises a cylinder tube 4, a piston 1 slidably installed inside this cylinder tube 4, a rod 6 connected to the piston, a bearing 9 supporting the rod 6, a tubular cylinder head 10 mounted in the front end of the cylinder tube and seals 12 and 13 mounted in contact with the rod 6 on an inner circumferential surface of the cylinder head 10; a cylindrical recess 19 is formed in the front end of the cylinder tube 4, the radius R of this cylindrical recess 19 is made larger by a predetermined dimension than the radius r of a piston sliding surface formed on the cylinder tube 4, a screw thread 19*a* is formed in this cylindrical recess 19, the cylinder head 10 is screwed into this cylindrical recess 19 and the bearing 9 supporting the rod 6 is mounted on an inner circumferential surface of this cylinder head 10.

11 Claims, 3 Drawing Sheets

HYDRAULIC CYLINDER AND ASSEMBLY METHOD THEREOF

BACKGROUND OF THE INVENTION

This invention relates to a hydraulic cylinder used mainly in fork lifts and the like, and particularly to a cylinder head structure thereof.

In an example of a conventional hydraulic cylinder shown in FIG. 3, a seal 2 and a bearing 3 are mounted on an outer circumferential surface of a piston 1 and this piston 1 is slidably installed inside a cylinder tube 4. A rod 6 is connected to one end of this piston 1 by way of a stopper 5.

When the piston 1 and the rod 6 have been installed in this way, a bearing holder 7 is inserted into the front end of the cylinder tube 4. A flange part 8 is formed on one end of this bearing holder 7, and this flange part 8 is caused to abut with the front end of the cylinder tube 4.

A bearing 9 is fitted to an inner circumferential surface of the bearing holder 7, and the rod 6 is supported by this bearing 9.

Also, a cylinder head 10 is mounted on the front end of the cylinder tube 4 in the following way. That is, a screw thread 4*a* is formed on the outer circumferential surface of the front end of the cylinder tube 4, this front end of the cylinder tube 4 is brought to face one of the open ends of the tubular cylinder head 10 and the two are screwed together. At this time, the flange part 8 is made to abut with a step part 11 formed on the inner surface of the cylinder head 10 and secures the bearing holder 7.

On the inner circumferential surface of the cylinder head 10 at the other open end thereof there is mounted a dust seal 12 for preventing the entry of extraneous matter from outside and a seal 13 for sealing the sliding of the rod 6 is mounted on the inner side of this. An O-ring 14 is provided adjacent to the threaded parts of the cylinder tube 4 and the cylinder head 10.

In this hydraulic cylinder, the inside of the cylinder tube 4 is divided by the piston 1 into a rod side chamber 15 and a bottom side chamber 16. A fluid is supplied to and discharged from the bottom side chamber 16 through a supply and discharge port 17. The rod side chamber 15 is charged with a fluid for lubrication and connected to a tank not shown in the drawings by a supply and discharge pipe 18.

In this hydraulic cylinder, when fluid is supplied through the supply and discharge port 17 into the bottom side chamber 16, the piston 1 moves into the rod side chamber 15 while discharging fluid in the rod side chamber 15 and as a result the rod 6 is extended.

When fluid is discharged through the supply and discharge port 17 from the bottom side chamber 16, the piston 1 moves into the bottom side chamber 16 and as a result the rod 6 is contracted.

However, in the conventional hydraulic cylinder described above, because the cylinder head 10 and the bearing holder 7 are different members, there are correspondingly numerous parts and this increases its cost also its weight.

Also, because the cylinder head 10 and the bearing holder 7 are different members, it is necessary to align their centers completely. If the centers of the cylinder head 10 and the bearing holder 7 are not aligned, the centers of the bearing 9 and the seals 12 and 13 also become misaligned and because the interferences of the seals 12 and 13 consequently become uneven in the circumferential direction of the rod 6 they cannot fully perform their sealing function and this results in fluid leakage and the entry of extraneous matter from outside.

Also, because the cylinder head 10 is screwed onto the outside of the front end of the cylinder tube 4, that part is enlarged to the diameter of the cylinder head 10. Consequently, when for example this hydraulic cylinder is used as a master cylinder of a fork lift, the fork lift operator's field of vision is impaired by an amount corresponding to this enlargement.

SUMMARY OF THE INVENTION

Accordingly, an object of this invention is to provide a hydraulic cylinder with which it is possible to promote cost reduction and weight reduction by reducing the number of parts, ensure that the sealing function is fully performed and also make possible a reduction in size.

A first aspect of the invention presupposes a hydraulic cylinder comprising a cylinder tube, a piston slidably mounted inside this cylinder tube, a rod connected to the piston, a bearing for supporting the rod, a tubular cylinder head mounted on the front end of the cylinder tube and a sealing member mounted in contact with the rod on an inner circumferential surface of the cylinder head.

A cylindrical recess is formed in the front end of the cylinder tube and the diameter thereof is made larger than the diameter of a piston sliding surface formed on the cylinder tube whereby a 0.3 mm to 1.5 mm step part is formed between the cylindrical recess and the piston sliding surface, the cylinder head is screwed into a screw part formed in this cylindrical recess and the bearing supporting the rod is mounted on an inner circumferential surface of this cylinder head.

A second aspect of the invention is a method of assembling a hydraulic cylinder according to the first aspect of the invention wherein a jig having a tubular part of a wall thickness substantially the same as the 0.3 mm to 1.5 mm step formed between the piston sliding surface and the cylindrical recess is inserted into the cylindrical recess and the piston is passed through the inside of this tubular part into the cylinder tube.

In the first aspect of the invention, because the cylinder head is mounted in a cylindrical recess in the front end of the cylinder tube, the cylinder head does not increase the diameter of this part of the hydraulic cylinder. Therefore, the hydraulic cylinder can be made small.

Furthermore, because the bearing supporting the rod is mounted on an inner circumferential surface of the cylinder head, it is not necessary to provide a bearing holder. Also, because the sealing members and the bearing are mounted on the same member, the cylinder head, the centers of the sealing members and the bearing can be aligned at all times.

In the second aspect of the invention, the wall thickness of the tubular part of the jig is made substantially the same as the step formed between the cylindrical recess and the piston sliding surface. As a result, when the tubular part of this jig is inserted into the cylindrical recess formed in the cylinder tube, the inner circumferential surface of the tubular part and the piston sliding surface of the cylinder can be made substantially aligned.

In these first and second aspects of the invention, the step formed between the piston sliding surface and the cylindrical recess is made 0.3 mm to 1.5 mm; the reason for this is as follows:

When this step is made large, the wall thickness of the tubular part of the jig is also made large to match this. When this wall thickness is made large, because the strength of the tubular part increases, even if the piston inclines inside the tubular part the inner surface of the tubular part is not dented.

It has been confirmed experimentally that the tubular part can be prevented from deforming in this way by the wall thickness of the tubular part being made 0.3 mm or more.

However, when the size of the step is set too large, machining of the cylindrical recess in the cylinder tube is hampered. That is, making the step large means making the cutting depth in the radial direction of the cylindrical recess deep, and the deeper this cutting depth is made the more cutting steps are necessary.

The depth of the cylindrical recess in the cylinder tube which can be cut in one step is generally 1.5 mm, and in this invention the upper limit of the step is made 1.5 mm for this reason.

If the step is set in the range 0.3 mm to 1.5 mm in this way it is possible to fully prevent deformation of the tubular part of the jig and furthermore it is possible to form the cylindrical recess with a cutting step consisting of only one feed of a lathe.

DETAILED DESCRIPTION OF THE PREFERRED EMBODIMENTS

Figure 1:
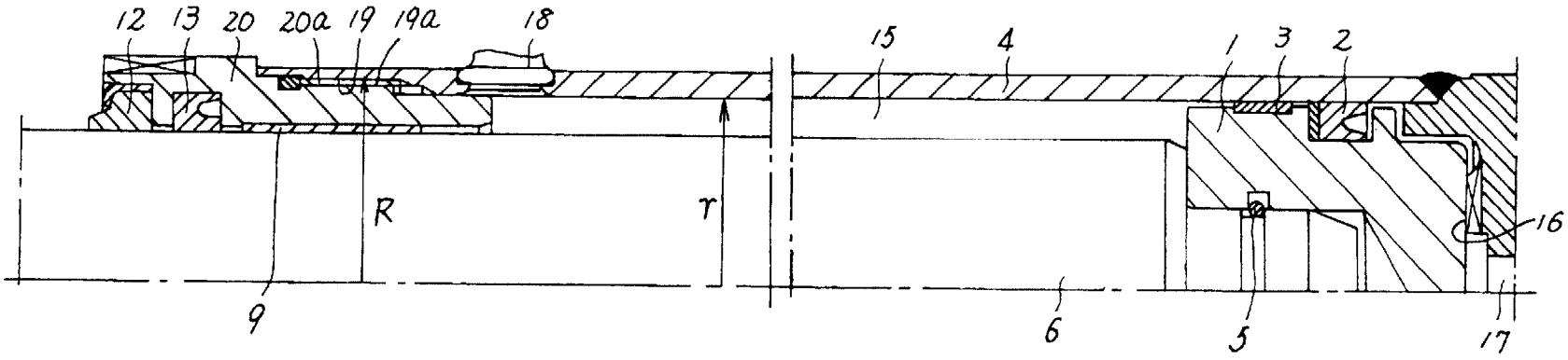
FIG. 1 is a partial sectional view of a hydraulic cylinder of a preferred embodiment of the invention.
Figure 2:
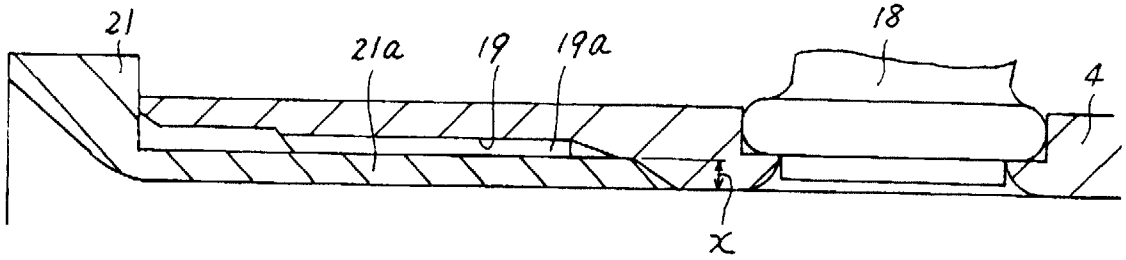
FIG. 2 is a sectional view of a main part of the hydraulic cylinder of the preferred embodiment of the invention showing a tubular part of a jig inserted into a cylindrical recess.
Figure 3:
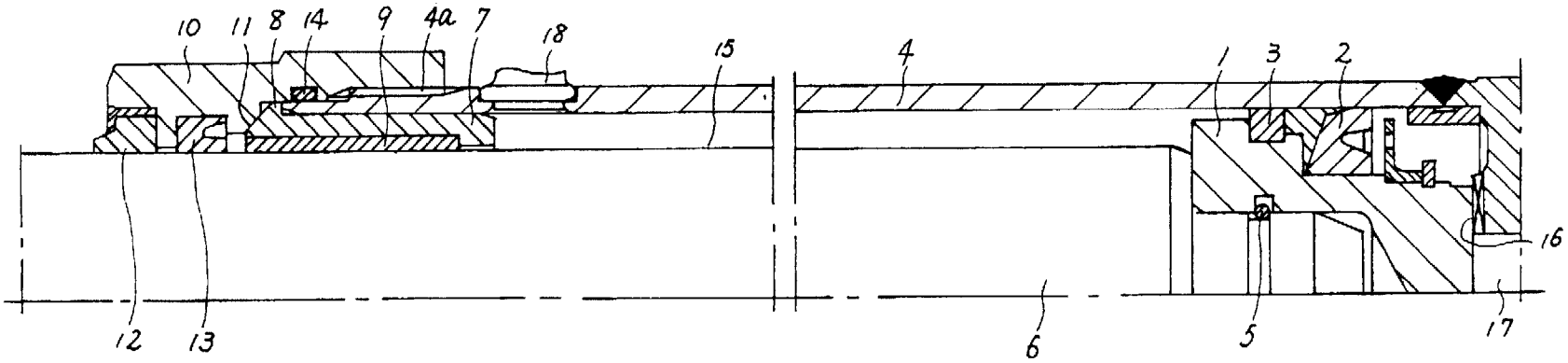
FIG. 3 PRIOR ART
FIG. 3 is a partial sectional view of an example of a conventional hydraulic cylinder.

The preferred embodiment of the invention shown in FIGS. 1 and 2 is the conventional example described above with the cylinder head changed. Because the rest of the construction of this preferred embodiment is substantially the same as that of the conventional example, the same constituent elements have been given the same reference numerals and a detailed description thereof will be omitted.

A piston 1 is slidably installed in a cylinder tube 4, and a cylindrical recess 19 having a radius R slightly larger than the radius r of the sliding surface of the piston 1 is formed in the front end of the cylinder tube 4. A screw thread 19*a* is formed in this cylindrical recess 19.

Also, a tubular cylinder head 20 has an external diameter substantially the same as the diameter of the cylindrical recess 19, and a thread 20*a* is formed on an outer circumferential surface thereof. A dust seal 12 and a seal 13 are mounted on the inner circumferential surface of this cylinder head 20, as in the conventional example described above, and a bearing 9 is also fitted to this surface.

Next, a method of assembling this hydraulic cylinder will be described.

First, as shown in FIG. 2, a jig 21 is inserted into the cylindrical recess 19. The jig 21 has a tubular part 21*a*, and the wall thickness of this tubular part 21*a* is substantially the same as the step x formed between the piston sliding surface of the cylinder tube 4 and the cylindrical recess 19. As a result, when this tubular part 21*a* is inserted into the cylindrical recess 19, the inner surface of the tubular part 21*a* and the piston sliding surface are substantially aligned.

If the piston 1 and the rod 6 are passed into the cylinder tube 4 through the inside of the tubular part 21*a*, it is possible to avoid the outer circumferential surface of the piston 1 and the seal 2 being scratched by the thread 19*a*.

The step x formed between the piston sliding surface of the cylinder tube 4 and the cylindrical recess 19 is set to 0.3 mm to 1.5 mm.

Next, the effects of the hydraulic cylinder of this preferred embodiment will be described.

In this hydraulic cylinder, the cylinder head 20 is screwed into cylindrical recess 19 formed in the front end of the cylinder tube 4. Also, the bearing 9 is fitted to the inner circumferential surface of this cylinder head 20 together with sealing members such as the dust seal 12 and the seal 13. As a result, it is not necessary to provide a bearing holder 7 as it is in the conventional example described above and the number of parts can be correspondingly reduced. If the number of parts can be reduced, cost reduction and weight reduction can be achieved.

Also, because the bearing 9 is mounted together with the dust seal 12 and the seal 13 on a single member, the cylinder head 20, the centers of these seals 12 and 13 and the bearing 9 do not become misaligned. If the centers of the seals 12 and 13 and the bearing 9 are aligned, because the interferences of the seals 12 and 13 are kept uniform in the circumferential direction of the rod 6, they can perform their sealing function well and leakage of fluid and entry of extraneous matter from outside can be surely prevented.

Furthermore, because the cylinder head 20 is inserted into the inside of the front end of the cylinder tube 4 it does not increase the diameter of this part and the hydraulic cylinder can be made smaller. Consequently, when for example this hydraulic cylinder is used as a master cylinder of a fork lift, the field of vision of the operator of the fork lift is impaired less by an amount corresponding to this decrease in size.

The step formed between the piston sliding surface of the cylinder tube 4 and the cylindrical recess 19 is made 0.3 mm to 1.5 mm for the following reasons:

When this step x is made large, the wall thickness of the tubular part 21*a* of the jig 21 is also made large to match this. When this wall thickness is made large, because the strength of the tubular part 21*a* increases, even if the piston 1 inclines inside the tubular part 21*a* the inner surface of the tubular part 21*a* is not dented.

It has been confirmed experimentally that the tubular part 21*a* can be prevented from deforming in this way by the wall thickness thereof being made 0.3 mm or more.

However, when the size of the step x is set too large, machining of the cylindrical recess 19 in the cylinder tube 4 is hampered. That is, making the step x large means making the cutting depth in the radial direction of the cylindrical recess 19 must be made deep, and the deeper this cutting depth is made the more cutting steps are necessary.

The depth of the cylindrical recess of the cylinder tube which can be cut in one step is generally 1.5 mm, and in this invention the upper limit of the step is made 1.5 mm for this reason.

If the step is set in the range 0.3 mm to 1.5 mm in this way it is possible to fully prevent deformation of the tubular part of the jig and also it is possible to form the cylindrical recess with a cutting step consisting of only one feed of a lathe.

According to the first aspect of the invention, because a bearing holder is not necessary the number of parts can be correspondingly reduced and it is possible to achieve cost reduction and weight reduction of the hydraulic cylinder.

Furthermore, because the centers of the seal members and the bearing are aligned, the interferences of the sealing members can be kept uniform in the circumferential direction of the rod. As a result, the sealing members can fully perform their sealing function and leakage of fluid and entry of extraneous matter from outside can be surely prevented.

Also, the diameter of the cylinder head does not enlarge that part of the hydraulic cylinder and consequently it is possible to reduce the size of the hydraulic cylinder.

According to the second aspect of the invention, it is possible to make the inner surface of the tubular part and the piston sliding surface of the cylinder tube substantially aligned. If in this state the piston is inserted into the cylinder tube through the inside of the tubular part, the outer circumferential surface of the piston and seals mounted on this outer circumferential surface are not scratched by the screw thread formed on the cylindrical recess.

Furthermore, in these first and second aspects of the invention, because the step is set in the range 0.3 mm to 1.5 mm, it is possible to prevent the tubular part from being dented and deforming and also the number of machining steps for forming the cylindrical recess does not increase.

What is claimed is:

1. In an arrangement for inserting a connected piston and rod into an interior of a cylinder tube, said piston being slidable along a piston sliding surface of the cylinder tube, the improvement comprising:

the cylinder tube having a substantially cylindrical inner surface defining a cylindrical recess at a front end of the cylinder tube, the diameter of the cylindrical inner surface being larger than the diameter of the piston sliding surface of the cylinder tube such that a 0.3 mm to 1.5 mm step is formed between the cylindrical inner surface and the piston sliding surface, and a jig arranged at least partially within the cylindrical recess and including a tubular wall having a thickness substantially the same as the 0.3 mm to 1.5 mm step formed between the cylindrical inner surface and the piston sliding surface, said jig having an opening through which the connected piston and rod are adapted to pass into the interior of the cylinder tube.

2. The arrangement of claim 1, wherein the inner surface of the tubular wall of the jig is substantially aligned with the piston sliding surface.

3. The arrangement of claim 1, further comprising a screw thread formed on the cylindrical inner surface of the cylinder tube.

4. The arrangement of claim 3, further comprising a tubular cylinder head structured and arranged to be mounted in the cylindrical recess and having a threaded outer surface cooperating with the screw thread on the cylindrical inner surface of the cylinder tube.

5. The arrangement of claim 4, wherein the external diameter of the tubular cylinder head is substantially the same as the diameter of the cylindrical inner surface of the cylinder tube.

6. The arrangement of claim 4, further comprising a bearing structured and arranged to be mounted on an inner circumferential surface of the tubular cylinder head for supporting the rod.

7. The arrangement of claim 6, further comprising a sealing member structured and arranged to be in contact with the rod and mounted on the inner circumferential surface of the tubular cylinder head.

8. The arrangement of claim 7, wherein the sealing member comprises a first seal and a second dust seal, said first and second seals being structured and arranged to be mounted on the inner circumferential surface of the tubular cylinder head.

9. The arrangement of claim 8, wherein said first seal, said second seal and said bearing are structured and arranged to be mounted such that the centers thereof are aligned with one another.

10. A method for assembling a hydraulic cylinder, the hydraulic cylinder including a cylinder tube having a substantially cylindrical inner surface defining a cylindrical recess at a front end of the cylinder tube, a piston mounted inside the cylinder tube structured and arranged to be slidable along a piston sliding surface of the cylinder tube the diameter of the piston sliding surface being smaller than the diameter of the cylindrical inner surface such that a 0.3 mm to 1.5 mm step is formed between the piston sliding surface and the cylindrical inner surface, a rod connected to the piston, a screw thread formed on the cylindrical inner surface of the cylinder tube, a tubular cylinder head mounted in the cylindrical recess and having a threaded outer surface cooperating with the screw thread on the cylindrical inner surface of the cylinder tube, a bearing mounted on an inner circumferential surface of the tubular cylinder head for supporting the rod, and a sealing member mounted on the inner circumferential surface of the cylinder head in contact with the rod, comprising the steps of:

before the connected piston and rod are mounted inside the cylinder tube, inserting a jig including a tubular wall having a thickness substantially the same as the 0.3 mm to 1.5 mm step formed between the piston sliding surface and the cylindrical inner surface into the cylindrical recess, and passing the connected piston and rod through the tubular wall into the cylinder tube.

11. The method of claim 10, further comprising the step of substantially aligning the inner surface of the tubular wall of the jig with the piston sliding surface.

* * * * *